US006019366A

United States Patent [19]

Tranquilla

[11] Patent Number: 6,019,366

[45] **Date of Patent: *Feb. 1, 2000**

[54] ELASTOMER DAMPING OF PIVOTED PINCH ROLL

[75] Inventor: Michael N. Tranquilla, Livonia, Mich.

[73] Assignee: Unisys Corporation, Blue Bell, Pa.

[ * ] Notice: This patent is subject to a terminal disclaimer.

[21] Appl. No.: 08/880,144

[22] Filed: Jun. 20, 1997

Related U.S. Application Data

[62] Division of application No. 08/658,295, Jun. 5, 1996, Pat. No. 5,645,275, which is a division of application No. 08/549,886, Oct. 30, 1995, Pat. No. 5,524,878, which is a division of application No. 08/076,292, Jun. 10, 1993, Pat. No. 5,303,913.

[51] Int. Cl.[7] ..... B65H 5/02

[52] U.S. Cl. ..... 271/274; 226/187

[58] Field of Search ..... 271/272, 273, 271/274, 314, 119; 226/181, 186, 187; 384/222

[56] References Cited

U.S. PATENT DOCUMENTS

| | | | |
|---|---|---|---|
| 2,642,318 | 6/1953 | Ricks | 384/222 |
| 3,072,397 | 1/1963 | Kelchner | 271/274 |
| 3,310,214 | 3/1967 | Nesin | 226/181 |
| 3,353,879 | 11/1967 | Jorn | 384/222 |
| 4,875,670 | 10/1989 | Petersen et al. | 271/273 |
| 5,303,913 | 4/1994 | Tranquilla | 271/274 |
| 5,524,878 | 6/1996 | Tranquilla | 271/274 |
| 5,645,275 | 7/1997 | Tranquilla | 271/274 |

FOREIGN PATENT DOCUMENTS

| | | | |
|---|---|---|---|
| 1263340 | 4/1960 | France | 271/274 |

*Primary Examiner*—H. Grant Skaggs
*Attorney, Agent, or Firm*—Rocco L. Adornato; Mark T. Starr; Steven B. Samuels

[57] ABSTRACT

A document feed array comprising a pinch-roll mounted to rotate about its center to engage documents, being mounted on a cantilever-arm pivoted at a point distal from the roll-center and including an elastomeric sleeve which, alone, couples the arm to its pivot point (in operation), the sleeve comprising high-damping, durable elastomeric material adapted to accommodate thickness anomalies in the documents, yet to maximize driving contact therewith.

13 Claims, 3 Drawing Sheets

FIG. 1A
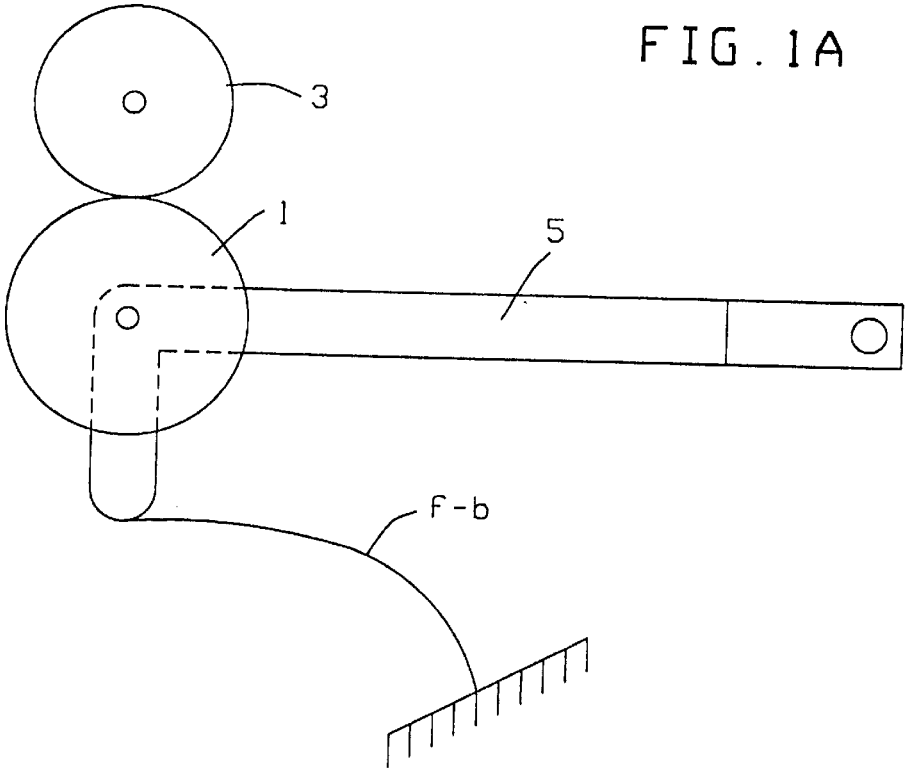
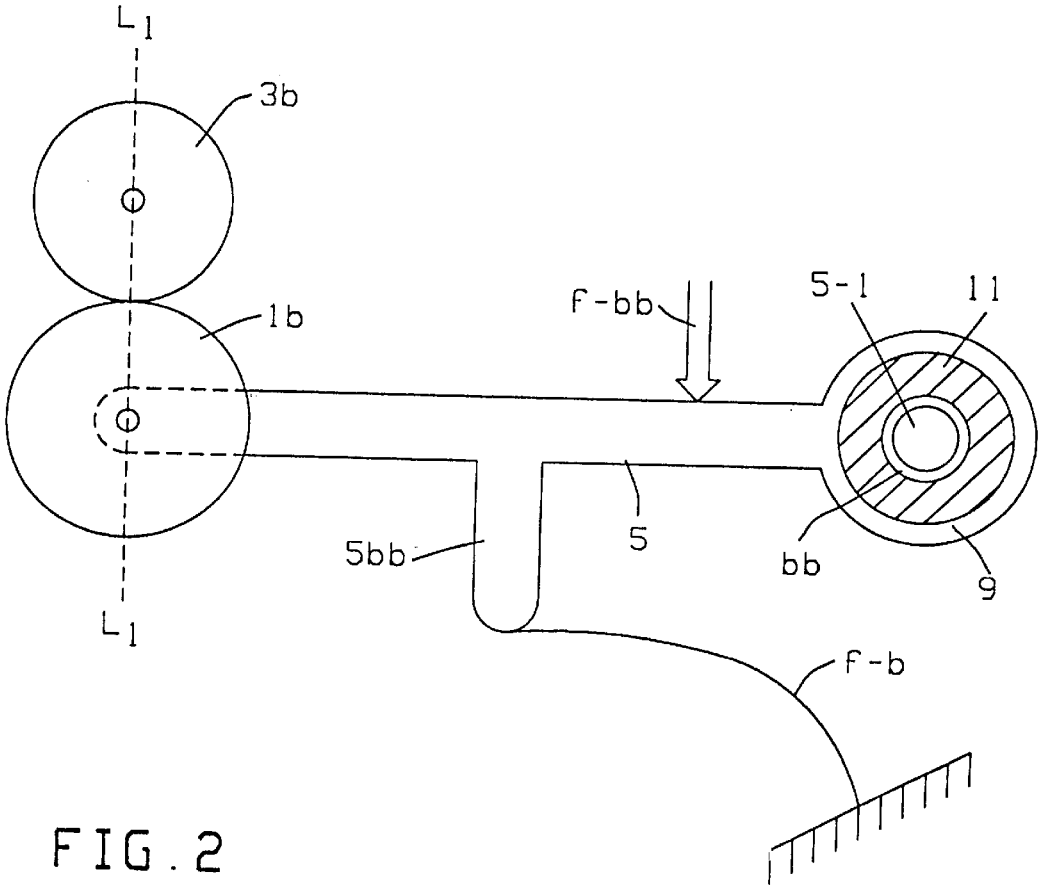
FIG. 2

ELASTOMER DAMPING OF PIVOTED PINCH ROLL

This is a Division, of U.S. Ser. No. 08/658,295, filed issued U.S. Pat. No. 5,645,275): which is a Division of Ser. No. 08/549,886, filed Oct. 30, 1995 (now U.S. Pat. No. 5,524,878) which is a Division of Ser. No. 08/076,292, filed Jun. 10, 1993 (now U.S. Pat. No. 5,303,913).

This invention relates to document transport equipment, and especially to pinch rolls therefor.

BACKGROUND FEATURES

Workers are aware that new and innovative high speed document transport systems are desirable. Workers are active in this field. Examples are described in U.S. Pat. Nos. 5,029,845, 4,974,680, 5,098,082, 5,172,900, 4,903,954, 4,346,883, 4,425,694. Many such systems have typically employed opposed pinch-rolls and to accommodate variance in document thickness etc., have used silient means therewith.

Previous resilient elements, such as air dashpots, bushings, sliding contact devices, and magnetic devices, require small gaps between components. These gaps collect paper dust which can interfere with normal functioning of the (movable) pinch roller. Other devices employ flexible damping material in the pinch roll (roller) itself. But this can cause overheating in the roller due to its constant rotation with a pinch load.

My invention avoids the foregoing problems, and involves means for damping a movable document transport pinch roller where the document transport must allow for gaps between documents, for documents of irregular thicknesses, and/or for unusual protrusions on the document such as staples and folds.

A salient object is to minimize transient motions of the movable pinch roll perpendicular to the document transport direction, so that the pinch rolls remain in intimate contact with the document at all times. Such transient motions occur where there are gaps between documents, irregular thicknesses, and/or protrusions such as staples or folds.

As a feature hereof, damping is provided through the use of a flexible damping material, such as poly-urethane, that also serves as a pivot bearing. A means of assembly prevents the damping material from experiencing a "static pre-load", and avoids related creep problems in the flexible damping material.

It is of particular interest to mount a movable pinch-roll or the like on an arm cantilevered-out from a pivot point defined by a fixed shaft, with this shaft surrounded by two concentric hollow cylinders plus intermediate high-damping elastomeric material, as in FIG. 1.

Additionally, a resilient pre-load is preferably applied as in FIG. 1A (e.g. via a flexure).

Thus, it is an object hereof to address (at least some of) the aforementioned problems, and to provide the herein-cited advantages and functions. A related object is to provide a moving pinch-roll mounted on a pivot arm, whose pivoting is resiliently resisted by flexible damping material.

The methods and means discussed herein, will generally be understood as constructed and operating as presently known in the art, except where otherwise specified; and with all materials, methods and devices and apparatus herein understood as implemented by known expedients according to present good practice.

DESCRIPTION OF FIGURES

FIG. 1A is a like view of a like arrangement showing flexure bias

FIG. 2 is a like view of a modified, less satisfactory arrangement showing a different bias-placement

PREFERRED EMBODIMENT

Figure 1:
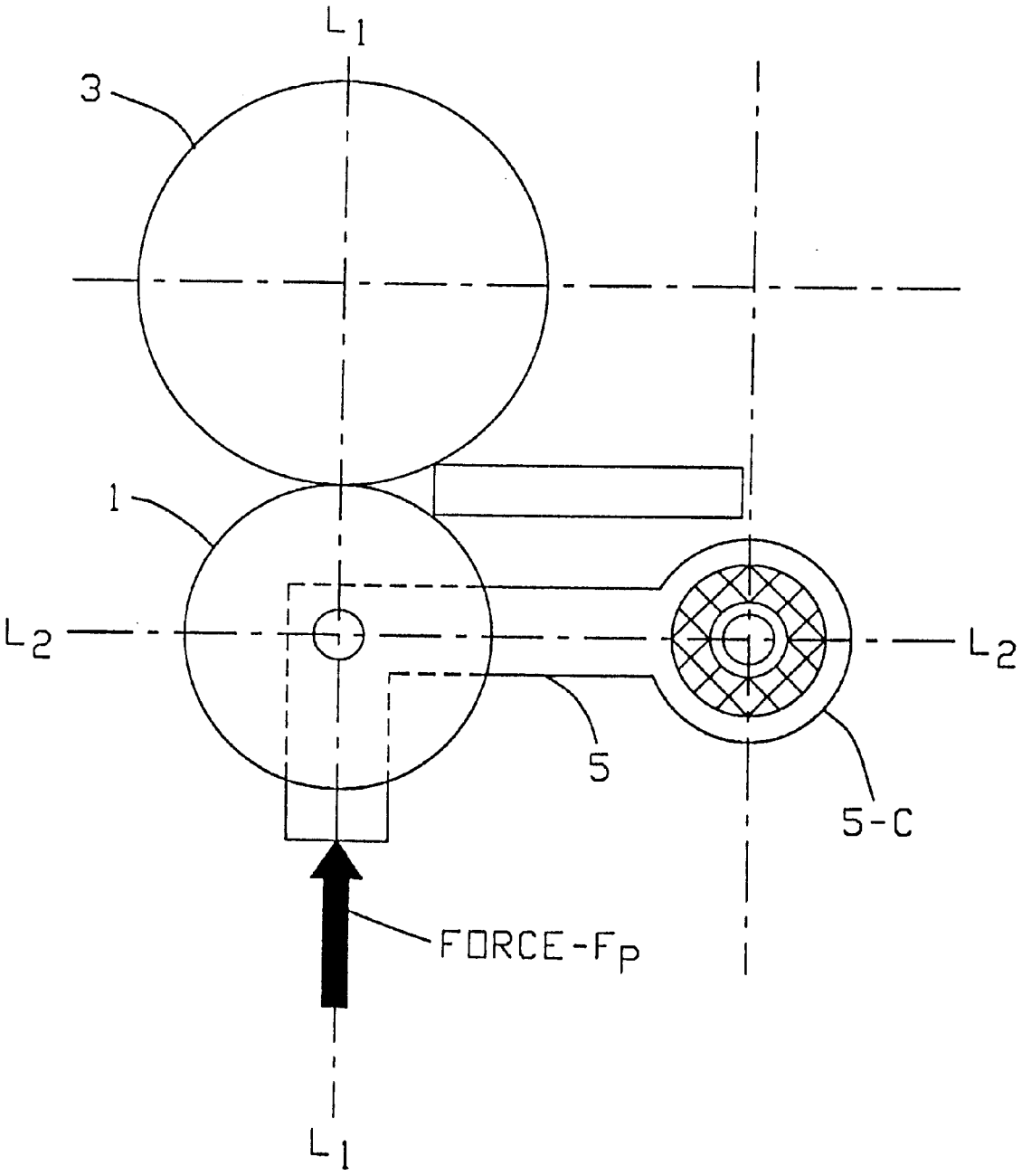
FIG. 1 is a very schematic sectional elevation of a preferred pinch roll embodiment.

FIG. 1 depicts a moveable pinch roll 1 opposed by a fixed drive roll 3 which may be assumed as rotated about its center by any number of known contemporary means. Normally, a document D is moved to the nip between this roll pair by known document feed means (eg. another upstream roll assembly, not shown—e.g. in a high-speed check-sorter). And the document will be withdrawn from this roll assembly 1,3 to output means, such as another roll pair or to a stacker (neither shown, but well known in the art).

Moving Pinch roll 1, is cantilevered-out on an arm 5 which is free to pivot about a fixed end (eg. on a shaft 7, usually with sealed ball bearings to minimize friction and to prevent paper dust from accumulating in the bearing.

This fixed end of arm 5 comprises a flexible pivot assembly including a rigid hollow outer cylinder-end, 5-C enclosing a resilient damping cylinder (tube or sleeve 11) which, in turn, surrounds a rigid hollow inner cylinder 9 mounted to rotate on fixed shaft 7. Damping sleeve 11 comprises flexible damping material bonded to outer cylinder 5-C, and to inner cylinder 9. Before operation of the transport, the inner cylinder 9 will be understood as free to rotate around fixed shaft 7.

A pre-load force Fp is preferably applied, and preferably along a line $L_1$—$L_1$ through the "nip", i.e. through pinch roll centers and the contact point between the two rolls. Line $L_1$—$L_1$ is perpendicular to a line $L_2$—$L_2$between the moving roll's center of rotation and the pivot point of arm 5 (fixed shaft 7). So applying the preload of arm 5 prevents static loads from developing on the flexible damping material 11, which could induce "creep" thereof and degrade bias Fp over time.

The pre-load force may be applied by any number of conventional means: coil spring, flexure, electric motor, magnets, hydraulic cylinder, etc., as known in the art.

Once preload force Fp is applied, the inner cylinder 9 is locked to fixed shaft 7, by any number of conventional means: set screw, clamp, bonding, welding, etc. When documents and/or protrusions thereon spread the roll 1,3 apart, arm 5 will be allowed to rotate about fixed shaft 7, but only via flexible material 11. [must twist or shear tube 11].

If this flexible material 11 is also "high damping," (eg. as poly-urethane, certain rubber and other elastomers), any tendency of the pinch rolls to "spread apart", open the "nip" and lose contact with a document (i.e. to move normal to the document transport direction) will be limited by this damping, resulting in the document remaining in more continuous, intimate contact with rolls 1, 3.

Elastomer Tube (sleeve) 11 will thus preferably be torsionally-stressed when any over-thickness anomaly, such as a staple, enters the "nip" and will quickly urge the moveable roll 1 back toward the driving roll 3 once the anomaly passes the nip. Tube 11 should do this quickly, with constant force (no large return-force required) and without fatigue, degradation (e.g. overheating) or material failure, despite possible high-frequency service. Thus, Tube 11 should exhibit good torsional elasticity (e.g. over small, high-frequency excursions and minor loads—but no great radial elasticity required). Tube 11 should thus be "high-damping" to resist such high-frequency excursions and very quickly return the moveable roll 1 with little or no bounce—e.g. vs. a lo-damping material that might tend more to "creep", or bounce or otherwise allow the nip to remain "open" or enlarged by an abnormal thickness discontinuity, and so allow the rolls to lose contact with a passing document. Preferred materials for Tube 11, like polyurethane will be recognized as suitable by workers (e.g. such as also used for flat drive-belts or the like). In certain instances, a part-tube (eg. 270° sector) may suffice.

Workers will appreciate the desireability of the pre-bias means, urging roll 1 vs. drive roll 3; and understand that, preferably, elastomer Tube 11 should not provide this, since such a relatively large, continuous static load could induce undesirable "creep" in the tube and so degrade the bias Fp over time. Thus, Tube 11 works better in conjunction with a separate pre-bias means as indicated in FIG. 1. A preferred example of such a ore-bias means is indicated by flexure f-b in FIG. 1A.

FIG. 1A will be understood as functionally equivalent to FIG. 1, while indicating use of a bias-flexure means f-b (eg. leaf spring as known in the art) to bear against a cooperating bias-detent projection 5-B of arm 5 adapted to direct bias force Fp along the nip-line $L_1$—$L_1$ between roll-centers as aforementioned.

Figure 3:
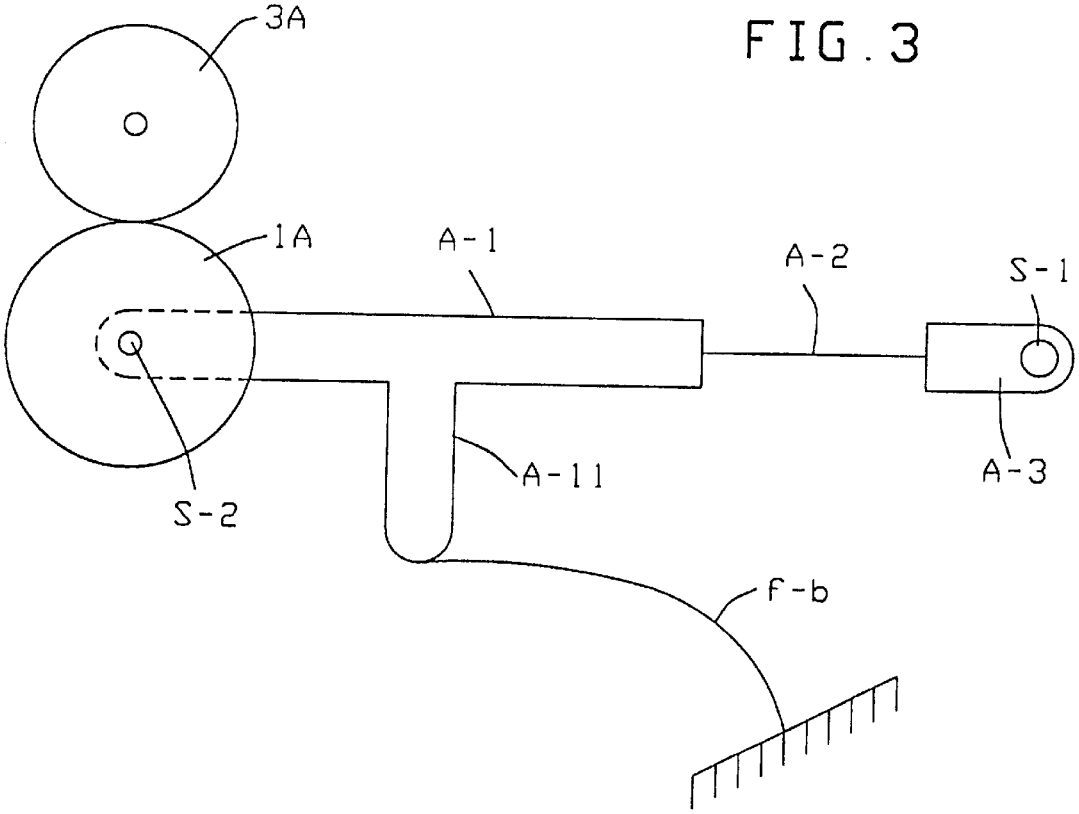
FIG. 3 is a like view of another modified less satisfactory arrangement showing a compound mounting-arm.
Figure 4:
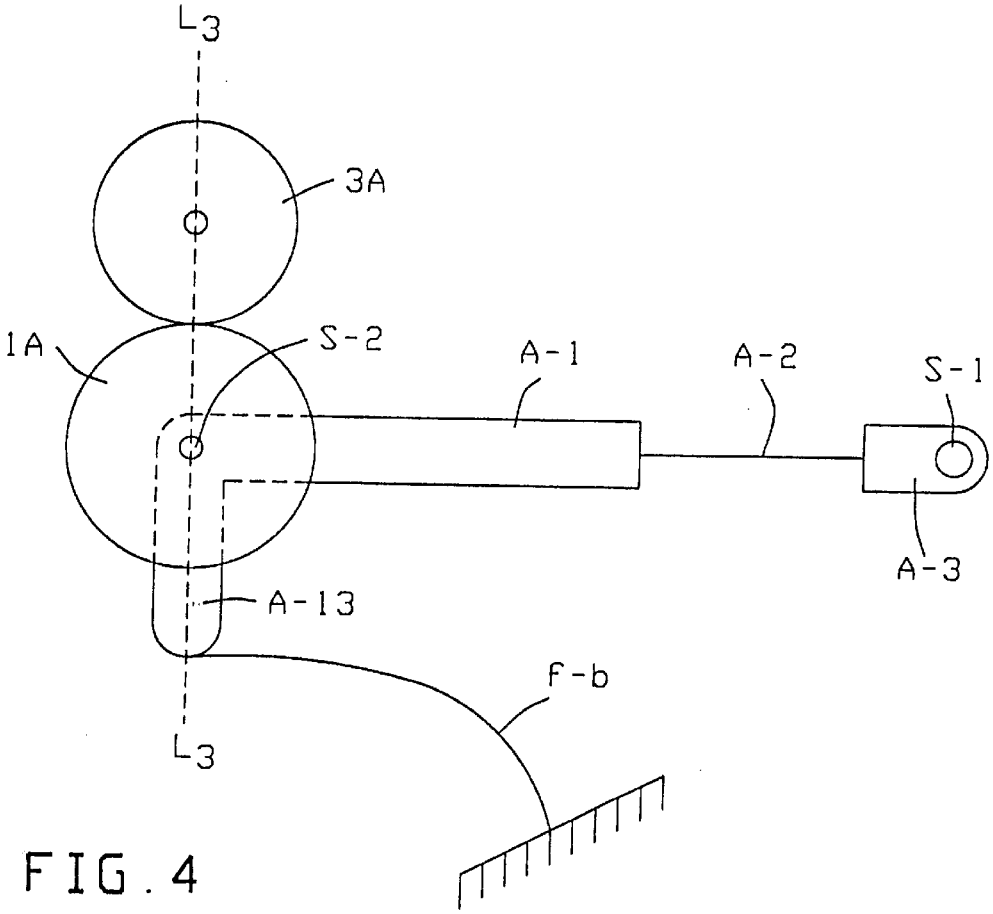
FIG. 4 is a like view of a satisfactory arrangement as in FIGS. 1, 1A, with bias applied along the roll-nip, and showing a compound mounting arm.

FIG. 4 shows a variation on FIG. 1A where a nip-bias flexure f-b is made to act along the nip-line $L_3$—$L_3$ (through the "nip", or rotation-center of rolls 1A, 3A—as with FIGS. 1, 1A); eg. so that a preload bias Fp can be applied, before locking pivot fixture A-3 on its shaft S-1, and thus without preloading the (damped) flexure arm-segment A-2. Here, as in FIG. 3, a compound (rigid/flexing) arm A-1, A-2 is used.

The foregoing (and other like) "roll-mount" embodiments will be seen as advantageously minimizing cost, assembly time etc., and will accommodate nip-anomalies, while quickly reacting and maximizing contact with the passing document.

Less satisfactory variations (FIGS. 2, 3):

FIG. 2 is a special, less-preferred case of FIG. 1A, where a like bias flexure f-b is applied to urge arm 5 and moving roll 1B vs. fixed drive roll 3B, except that flexure f-b is applied vs a bias-extension 5-b of arm 5 which is "offset" from the nip-line $L_1$—$L_1$ between roll centers.—this is less desirable. Also, a bushing (metal cylinder) bb is here bonded to eslastomer cylinder 11 and mounted to rotate freely on fixed shaft 7-1 (eg. on bearings, if necessary). Thus, one may apply the flexure preload (with f-b) and then lock bushing bb in place, on shaft 7-1, to prevent its further rotation.

Also, damping means f-bb may optionally be applied to damp vibration, of arm 5; eg. via suitable damping flexure means f-bb, as workers will appreciate.

The FIG. 2 configuration (with detent 5-bb displaced from Line $L_1$—$L_1$ through the nip), is disfavored principally because it tends to put resilient Tube 11 in long-term static tension and thus may weaken it over time, or degrade $F_P$.

In FIG. 3, rolls 1A, 3A are opposed, with moveable roll 1A mounted to rotate on the distal end of a composite arm AA, comprising a rigid distal section A-1, coupled to a proximal resilient section (flexure leaf or the like) A-2, which is cantilevered-out from a rigid pivot fixture A-3, mounted to rotate on a fixed shaft S-1. Pivot fixture A-3 is preferably adapted to rotate loosely on 7-1 until locked thereon (eg. by known means, such as set-screw means—not shown, but well known in the art). —This may be done after arm AA is rotated so that moveable idler roll 1A contacts drive roll 3A. Preferably, resilient arm segment A-2 is also provided with damping means, as known in the art.

Moving idler roll 1A is mounted to rotate on its own fixed shaft S-2, mounted from arm segment A-1. (as known in the art; not illustrated in detail).

As in FIG. 2, offset pre-bias means is also provided to resiliently urge moveable roll 1A into contact with drive roll 3A (eg. via flexure leaf f-b, pushing arm-extension A-11, (provided as known in the art). Such a "compound" (rigid/flexible) mounting arm (A-1, A-2) may be less preferred in some instances (vs. a fully-rigid arm as in FIGS. 1, 1A).

Problem in FIGS. 2, 3:

The arrangements of FIGS. 2 and 3 would be satisfactory, in general, except that they apply an "offcenter-preload", i.e. other than along the "nip-line" (e.g. $L_1$—$L_1$ in FIG. 1) which undesirably places a static preload on the elastomer sleeve 11 of FIG. 2 or on the flexible element of FIG. 3. This will tend to cause "creep" problems, as workers can imagine—and so is best avoided—in favor of a preload which is "centered", i.e. along the "nip-line".

Conclusion

It will be understood that the preferred embodiments described herein are only exemplary, and that the invention is capable of many modifications and variations in construction, arrangement and use without departing from the spirit of the invention.

Since modifications of the invention are possible, for example the means and methods disclosed herein are also applicable to other pinch roll mounting arrangements, as well as to other related and unrelated document-advance components; and it will be understood that the present invention is also applicable for enhancing other related sheet-advance arrangements (eg. document sorters, mail sorters, copiers, page feeders for printers, punch card transports, envelope stuffing machines, money feeders & transports in automatic teller machines.)

Examples given above of other possible variations of this invention are merely illustrative. Accordingly, the present invention is to be considered as including all possible modifications and variations within the scope of the invention as defined by and set forth in the appended claims.

What is claimed is:

1. Apparatus for damping motion perpendicular to a document transport track as a document passes through a feed nip, the apparatus comprising:

a shaft;

a bushing locked around the shaft;

an elastomeric damping member bonded to the bushing;

an arm including a cylindrical end bonded to the elastomeric damping member, the arm further including a further end, the arm being pivotable about the shaft;

a drive roller disposed proximate a side of the document track;

a pinch roller disposed opposite the document track from the drive roller, the pinch roller being rotateably joined to the further end of the arm and being movable relative to the drive roller, the drive roller and the pinch roller defining the feed nip therebetween;

whereby the document displaces the pinch roller from the drive roller and rotates the cylindrical end relative to the bushing as the document passes through the feed nip, and whereby the elastomeric damping member is bonded between the bushing and the cylindrical end of the arm to damp rotation therebetween.

2. The apparatus of claim 1, wherein the elastomeric damping member is a cylindrical sleeve.

3. The apparatus of claim 2, wherein the cylindrical sleeve is disposed concentrically between the cylindrical end and the bushing.

4. The apparatus of claim 1, further comprising means for applying a preload force to the arm to urge the pinch roller toward the drive roller.

5. The apparatus of claim 4, wherein the arm includes a bias extension and wherein the applying means is adapted to apply the preload force to the bias extension.

6. The apparatus of claim 5, wherein the bias extension is perpendicular to the arm and extends from the further end of the arm.

7. The apparatus of claim 5, wherein the bias extension is perpendicular to the arm and extends from a point intermediate the cylindrical end and the further end of the arm.

8. Apparatus for damping motion perpendicular to a document transport track as a document passes through a feed nip, the apparatus comprising:

a shaft having an outside diameter;

a bushing having an inside diameter and an outside diameter and being positioned in concentric relation to the shaft, the inside diameter of the bushing being locked around the outside diameter of the shaft;

an elastomeric damping member having an inside diameter and an outside diameter and being positioned in concentric relation to the shaft and to the bushing, the inside diameter of the bushing being bonded to the outside diameter of the bushing;

an arm including a cylindrical end having an inside diameter bonded to the outside diameter of the elastomeric damping member, the arm further including a further end, the arm being pivotable about the shaft;

a drive roller disposed proximate a side of the document track;

a pinch roller disposed opposite the document track from the drive roller, the pinch roller being rotateably joined to the further end of the arm and being movable relative to the drive roller, the drive roller and the pinch roller defining the feed nip therebetween;

whereby the document displaces the pinch roller from the drive roller and rotates the cylindrical end relative to the bushing as the document passes through the feed nip, and whereby the elastomeric damping member is bonded between the bushing and the cylindrical end of the arm to damp rotation therebetween.

9. Apparatus for damping motion perpendicular to a document transport track as a document passes through a feed nip, the apparatus comprising:

a shaft;

a pivot fixture locked around the shaft;

a flexure arm segment coupled to the pivot fixture;

a rigid arm segment including a first end joined to the flexure arm segment and a further end, the rigid arm segment being flexible relative to the pivot fixture;

a drive roller disposed proximate a side of the document track;

a pinch roller disposed opposite the document track from the drive roller, the pinch roller being rotateably joined to the further end of the arm and being movable relative to the drive roller, the drive roller and the pinch roller defining the feed nip therebetween;

whereby the document displaces the pinch roller from the drive roller and flexes the rigid arm segment relative to the pivot flexure as the document passes through the feed nip, and whereby the flexure arm segment is bonded between the pivot fixture and the rigid arm segment to damp flexure therebetween.

10. The apparatus of claim 9, further comprising means for applying a preload force to the rigid arm segment to urge the pinch roller toward the drive roller.

11. The apparatus of claim 10, wherein the rigid arm segment includes a bias extension and wherein the applying means is adapted to apply the preload force to the bias extension.

12. The apparatus of claim 11, wherein the bias extension is perpendicular to the rigid arm segment and extends from the further end of the rigid arm segment.

13. The apparatus of claim 11, wherein the bias extension is perpendicular to the rigid arm segment and extends from a point between the cylindrical end and the further end of the rigid arm segment.

* * * * *